United States Patent [19]

Han

[11] 4,370,068

[45] Jan. 25, 1983

[54] HOUR AND MINUTE DISPLAY FOR A CHRONOMETER

[76] Inventor: Jeong S. Han, 189-42 Bukahyun-Dong, Seodaimun-ku, Seoul, Rep. of Korea

[21] Appl. No.: 178,616

[22] Filed: Aug. 15, 1980

[51] Int. Cl.[3] ..... G04C 17/02

[52] U.S. Cl. ..... 368/240

[58] Field of Search ..... 368/239, 240, 242, 82, 368/83, 84, 79, 241

[56] References Cited

U.S. PATENT DOCUMENTS

| | | | |
|---|---|---|---|
| 3,823,549 | 7/1974 | Feldman | 368/82 |
| 3,841,082 | 10/1974 | Cuevas et al. | 368/82 |
| 3,987,617 | 10/1976 | Slob | 368/242 |

FOREIGN PATENT DOCUMENTS

| | | | |
|---|---|---|---|
| 2403383 | 8/1974 | Fed. Rep. of Germany | 368/84 |

*Primary Examiner*—Bernard Roskoski

*Attorney, Agent, or Firm*—Christensen, O'Connor, Johnson & Kindness

[57] ABSTRACT

An hour and minute display for an electronic chronometer includes a plurality of first indicators positioned in spaced relation about the perimeter of a closed geometric figure. The first indicators are actuatable to indicate the hour. A plurality of second indicators are positioned about a closed geometric figure adjacent the first indicator. The second indicators are selectively actuatable to indicate minutes past the hour in 5-minute increments. Also positioned adjacent the first indicators is a third indicator capable of being actuated to selectively indicate increments of one, two, three or four minutes past the displayed 5-minute increment. The first, second and third indicators are preferably driven by digital counter circuits commonly employed in conventional electronic chronometers.

12 Claims, 2 Drawing Figures

HOUR AND MINUTE DISPLAY FOR A CHRONOMETER

BACKGROUND OF THE INVENTION

This invention relates to clocks and watches and, more particularly, relates to the display of hours and minutes on the face of such clock or watch.

Conventional clocks and watches having numerals or other indicia arranged on the face thereof wherein a pair of hands move about the face of the clock to indicate the time of day are well known. In such a type of timepiece substantially the entire face of the instrument is occupied by the indicia and the hands making it impractical and inconvenient to display other types of information. The advent of electronic timepieces utilizing liquid crystal displays or utilizing light-emitting diode display units has enabled those in the art to produce instruments to indicate the time of day by a side-by-side display of numerals representing the hour and minutes past the hour. These so-called "digital" timepieces also utilize substantially the entire face of the watch for the hour and minute display since the numerals must be large enough to be easily read by the wearer of the watch or viewer of the clock.

It is therefore an object of the invention to provide a display of hours and minutes for a watch or other timepiece which utilizes only the outer perimeter of the watch face, thereby leaving the central portion of the face available for other displays.

It is a further object of this invention to provide such an hour and minute display that is easily visible to the wearer of a watch or viewer of a clock, and by means of which the hour and minute display is readily decipherable.

It is another object of this invention to provide such an hour and minute display that is relatively inexpensive to produce and maintain and is readily adaptable to a variety of watch face shapes.

SUMMARY OF THE INVENTION

In accordance with the above-stated objects, there is provided an hour and minutes display for an electronic chronometer which includes a plurality of first indicators that are positioned in spaced relationship about the perimeter of a closed geometric figure and are selectively actuatable to indicate the hour. In proximity to the hour indicators are positioned a plurality of second indicators, each indicator selectively actuatable for the purpose of indicating the time after the hour in 5-minute increments. Positioned intermediate two of the hour indicators and still on the perimeter of the closed geometric figure is a third indicator capable of being selectively activated to indicate increments of one, two, three or four minutes. The first, second and third indicators are preferably driven by digital counter circuits or other conventional clock driving means commonly employed in conventional electronic chronometers.

A preferred embodiment of the hour and minute display is adapted for a 12-hour clock. In this embodiment, there are 12 first indicators, each capable of selective activation to indicate the hour with respect to the standard 12-hour periods known as ante-meridian (am) and post-meridian (pm). A set of 11 second indicators, alternately interspersed between hour indicators, individually indicate the passage of five minutes so that the set of 11 indicators is capable of indicating up to 55 minutes. The third indicator is preferably in the shape of a closed geometric shape that is divided into four segments, each of the four segments being selectively energizable to thereby indicate from one to four minutes of time. In this arrangement, one segment is activated to indicate one minute, two segments are activated to indicate two minuts, and so on.

BRIEF DESCRIPTION OF THE DRAWINGS

The objects and advantages of the invention will be better understood upon a reading of the ensuing specification taken in conjunction with the attached drawings wherein.

DETAILED DESCRIPTION OF THE PREFERRED EMBODIMENT

Figure 1:
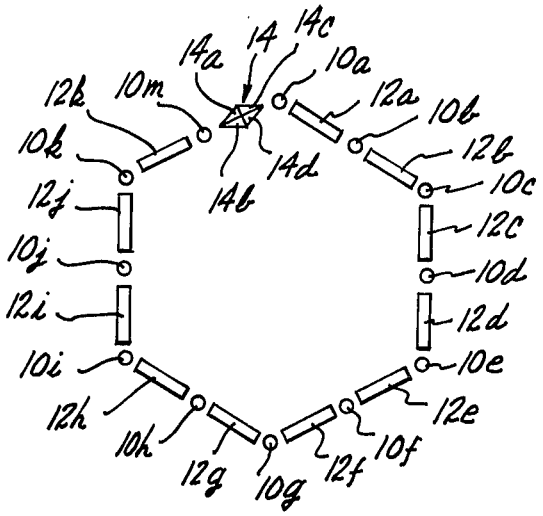
FIG. 1 is an illustration of an hour and minute display for a watch face made in accordance with the principles of the present invention.

Referring now to FIG. 1, an hour and minute display for use with an electronic chronometer made in accordance with the principles of the present invention is arranged on the perimeter of a hexagon. A plurality of circular first display means 10*a*–10*m* are arranged about the hexagon and are located at the vertices of the hexagon and at the midpoints of the sides of the hexagon. The first display means 10*a*–10*m* are selectively energized by a driver means, to be described below, to indicate the hour to be displayed on the watch face. In the illustrated embodiment, the display means 10*a* is energized to indicate 12:00, the display means 10*b* is energized to indicate 1:00, and so on in a clockwise direction such that display means 10*m* is energized to indicate 11:00. The display means 10*a*–10*m* can be any suitable light-emitting means such as, for example, a liquid crystal display element or light-emitting diode. On a large clock face, the display means can consist of a standard incandescent or fluorescent device or neon tube, depending on the particular application.

Minutes are indicated on the clock by second display means 12*a*–*k* located along the sides of the hexagon intermediate pairs of first display means 10*a*–*m*. The second display means are in the shape of rectangular bars and are utilized to indicate 5-minute increments after the hour. More specifically, indicator 12*a* of the depicted arrangement is energized to indicate five minutes past the hour, indicator 12*b* is energized to indicate ten minutes past the hour, and so on in the clockwise direction until indicator 10*k* is energized to indicate 55 minutes after the hour. As in the case of the first display means 10*a*–*m*, the second display means can be any suitable indicator, for example, light-emitting diodes or liquid crystal displays or, again, in a larger instrument can consist of incandescent or fluorescent lights or neon tubes.

The space on the perimeter of the hexagon between first display 10*m* and first display means 10*a* is occupied by a third display means 14 utilized to indicate increments of from one to four minutes and used in conjunction with the second display means to bridge between 5-minute increments. In the illustrated embodiment, the third display means is in the shape of a diamond with its longer dimension oriented parallel to the side of the hexagon. The opposite apexes of the diamond are joined by straight lines dividing the diamond into four triangular segments 14*a, b, c,* and *d.* The segments are capable of selective independent activation by the driver means at 1-minute increments such that the segment 14*a* is energized to indicate one minute past the indicated 5-minute increment. Likewise, the segments 14*a* and 14*b* are both energized to indicate two minutes past any particular 5-minute increment; segments 14*a*, 14*b* and 14*c* are energized to indicate three minutes past the displayed 5-minute increment; and segments 14*a*, 14*b* 14*c* and 14*d*, are energized to indicate four minutes past an indicated 5-increment. Of course, if an even 5-minute increment is to be displayed, none of the segments 14*a–d* are activated. As in the case of the first and second display means, the third display means 14 can also comprise conventional light-emitting diodes, a liquid crystal display or incandescent or fluorescent light, depending upon the particular application.

Utilizing the indicators as illustrated, the method of displaying the passage of one to fifty-nine minutes is described as follows: One minute is shown by one energized segment, e.g., 14*a* of the third indicator means 14. Likewise, two minutes are displayed by energizing two triangular segments, e.g., 14*a* and 14*b*. Similarly, three segments are energized for three minutes and four segments for four minutes. When the 5-minute increment is to be indicated, the four triangular segments of the third display means 14 are extinguished and the second display means 12*a* is energized. A 6-minute indication is represented by the second display means 12*a* and one triangular segment of the third display means 14, for example, 14*a* being energized. Similarly, successive triangular segments are energized until a 10-minute indication is to be displayed, at which point the four triangular segments are extinguished and the second display means 12*b* is energized. At this juncture two possible methods can be followed, either the second display means 12*b* can be the only 5-minute indicator that is activated or both display means 12*a* and 12*b* can be energized to indicate a 10-minute increment. The pattern of energizng particular display means continues throughout the time interval of 59 minutes, at which time, depending on the method chosen from the above two listed methods, either the display means 12*k* and the four segments of third display means 14 are energized or, alternatively, all of the second display means 12*a*–12*k* are energized and the four segments of third display means 14 are energized.

To indicate a change of hour, the second and third display means are all extinguished and the appropriate hour indicator 10*a*–10*m* is energized to indicate the correct hour. As described above in connection with the minute display, either of two methods can be used for displaying the hour. In particular, only the first indicator corresponding to the correct hour can be energized or all the first indicators up to and including the one corresponding to the correct hour can be activated.

Figure 2:
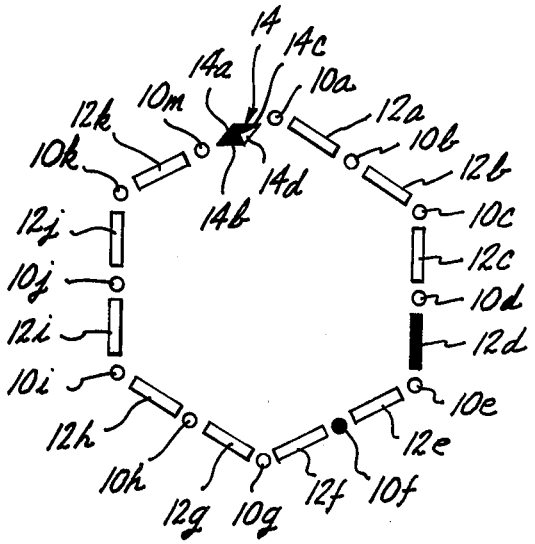
FIG. 2 is an illustration of the watch face of FIG. 1 showing a particular hour and minute indication.

As a further illustration of the operation of the chronometer display of the present invention, a particular time indication is shown in FIG. 2. The time which is illustrated is 5:23 and can be determined by noting that the first display means 10*f* is energized, with that display being in the 5:00 position. Concurrently, the second display means 12*d* is energized, which is in the fourth 5-minute increment position, i.e., the position corresponding to four times five minutes or twenty minutes after the hour. Also, segments 14*a*, *b* and *c* of the third display means 14 are activated, indicating three minutes past the nearest 5-minute increment. Accordingly, the total display indicates five hours and twenty-three minutes or 5:23.

It will be recognized by those skilled in the art that the display means of this invention can be selectively energized in the manner utilized in conventional electronic chronometers. More specifically, the timing of operation of the light driver means can be controlled by a suitable stable oscillator such as a crystal controlled oscillator which produces a high-frequency signal having a frequency or pulse repetition rate that is a large integral multiple of 60 pulses per minute. This signal is processed by means of conventional frequency divider or counter circuits to supply signals having a pulse repetition rate of one pulse per minute; one pulse per five minute interval; and one pulse per hour. In this regard, it will be recognized that prior art electronic watches employ each of these signals, except for the signal having a pulse repetition rate of one pulse per 5-minute interval. Accordingly, the invention at most requires a slight modification to conventional electronic chronometer arrangements wherein a divide-by-five operation is effected relative to the signal provided at one pulse per minute.

As discussed above, the hour and minute display of the present invention can be used for the face of various clocks or watches, for example, those that utilize liquid crystal displays or light-emitting diodes. For large wall clocks or display signs, neon tubes or fluorescent light strips can be utilized for the display means of the present invention. Also, the particular display means can be other shapes than those illustrated. For example, the circular and rectangular elements that respectively form the first and second display means of the depicted embodiment can be differently sized circles or triangles or whatever geometric shape is desired.

As can be seen from the illustration, the hour and minute display of the present invention utilizes only the perimeter of the hexagon leaving the central area of the hexagon available for other information, such as day-of-the-week or date or for ornamental purposes, such as pictures, a pleasing design, or even promotional messages. A watch or clock utilizing the hour and minute display of the present invention can then be crafted as a work of art, a piece of jewelry, or an advertising display with relative ease when compared to conventional watch or clock faces. Further, although the hour and minute display of the present invention is described and illustrated arranged on the perimeter of a hexagon, any closed geometric shape can be utilized in the display of the present invention. For example, a 12 sided polygon could be utilized with the first display means being located at each of the vertices of the polygon and the second display means lying along the entire side of the polygon. Alternatively, a circle could be utilized as the underlying geometric figure upon which the hour and minute display is placed, in which case the second display means could be formed into circular segments of that circle rather than the straight lines illustrated. Also, the second display means could be positioned on the perimeter of a second closed geometric figure concentric with the figure on which the first display means are positioned.

In summary, therefore, an hour and minute display for an electronic chronometer is provided including a plurality of first display means arranged in spaced relationship about the perimeter of a closed geometric figure for indicating the hour. The display further includes a plurality of second display means for indicating the minutes past the hour in 5-minute increments. The second display elements are preferably spaced about the same geometric figure in alternation with the first display means. The display also includes a third display means divided into four segments, each of the segments being selectively activated to indicate 1-minute increments past the nearest 5-minute increment to bridge between successive 5-minute increments.

It will be apparent to those of ordinary skill in the art and others that while a preferred embodiment of the present invention has been described and illustrated, many changes can be made to that illustrated embodiment while remaining within the scope and spirit of the present invention. The invention, therefore, should be defined solely by reference to the claims which follow.

The embodiments of the invention in which a property or privilege is claimed are defined as follows:

1. An hour and minute display for the face of a chronometer, said chronometer face including a perimeter portion and a central portion, said hour and minute display comprising:

a plurality of first display means selectively actuatable to indicate a desired hour, said first display means being arranged in spaced relation to one another along the perimeter of a first closed geometric figure, said perimeter of said first closed geometric figure lying within the perimeter portion of said chronometer face, said first display means surrounding said central portion of said chronometer face;

a plurality of second display means selectively actuatable to indicate five-minute increments past the hour, the number of second display means being one less than the number of first display means, said second display means being arranged in spaced relation to one another about the perimeter of a second closed geometric figure in cooperative relation to said first display means, said perimeter of said second closed geometric figure lying within said perimeter portion of said chronometer face and said second display means surrounding said central portion of said chronometer face; and third display means selectively actuatable to indicate time increments of one, two, three, or four minutes, said second and third display means cooperably actuatable to indicate time increments from one to 59 minutes, said third display means being arranged along the perimeter of said second closed geometric figure, said third display means occupying substantially the same amount of space as one of said second display means, said first, second and third display means lying within the perimeter portion of said chronometer face so as to leave the central portion of said chronometer face free of any hour or minute displays.

2. The hour and minute display of claim 1 wherein said third display means is in the shape of a third closed geometric figure, said figure being divided into four segments, said first segment being actuatable to indicate a 1-minute increment, said first and second segments being concurrently actuatable to indicate a 2-minute increment, said first, second and third segments being concurrently actuatable to indicate a 3-minute increment and said first, second, third and fourth segments being concurrently actuatable to indicate a 4-minute increment.

3. The hour and minute display of claims 1 wherein said first closed geometric figure is a hexagon, one of said first display means being located at each vertex of the hexagon and at the midpoint of each side of said hexagon.

4. The hour and minute display of claim 3 wherein said first display means are in the shape of circles.

5. The hour and minute display of claim 4 wherein said first and second closed geometric figures are substantially coincident and said second display means are in the shape of elongated bars, said bars being oriented with their elongated dimension parallel to sides of said hexagon, each of said bars being located between adjacent ones of said first display means.

6. The hour and minute display of claims 1 wherein said first and second geometric figures are substantially coincident with one another.

7. The hour and minute display of claim 5 wherein said first, second, third, and fourth segments of said third display means are in the shape of triangles, said triangles being positioned adjacent one another to form a diamond having a short dimension from a first apex to a second apex and a long dimension from a third apex to a fourth apex, said diamond being positioned such that the long dimension of said diamond is parallel to a side of said hexagon and lies between two adjacent first display means.

8. The hour and minute display of claim 5 or 7 wherein there are 12 of said first display means and 11 of said second display means.

9. An hour and minute display for the face of a chronometer, said chronometer face including a perimeter portion and a central portion, said hour and minute display comprising:

a plurality of first display means selectively actuatable to indicate a desired hour, said first display means being spaced apart from one another along the perimeter of a hexagon, with one of said first display means being located at each vertex of said hexagon and one of said first display means being located at the midpoint of each side of said hexagon, said hexagon perimeter lying within said perimeter portion of said chronometer face surrounding said central portion, said central portion being free of any hour or minute displays;

a plurality of second display means selectively actuatable to indicate a desired 5-minute increment past the hour, the number of second display means being one less than the number of first display means said second display means being arranged in spaced relation to one another about said hexagon perimeter intermediate adjacent pairs of said first display means;

third display means in the shape of a closed geometric figure, said third display means being divided into a first segment, a second segment, a third segment and a fourth segment, each of said segments being individually and selectively actuatable, said first segment being actuatable to indicate a time increment of one minute, said first and second segments being concurrently actuatable to indicate a time increment of two minutes, said first, second and third segments being concurrently actuatable to indicate a time increment of three minutes, and said first, second, third and fourth segments being concurrently actuatable to indicate a time increment of four minutes, said third display means being arranged on the perimeter of said hexagon between two adjacent first display means.

10. The hour and minute display of claim 9 wherein said first, second, third and fourth segments of said third display means are in the shape of triangles, said triangles being arranged to form a diamond having a long dimension from a first apex to a second apex and a short dimension from a third apex to a fourth apex, said diamond being arranged on said hexagon perimeter such that said long dimension is substantially parallel to one side of said hexagon.

11. The hour and minute display of claim 9 or 10 wherein said first display means are in the shape of circles and said second display means are in the shape of elongate bars, said elongate bars being arranged with their elongate dimension parallel to the sides of said hexagon.

12. The hour and minute display of claim 11 wherein said first, second and third display means comprise light-emitting devices.

* * * * *